United States Patent [19]

Hawley et al.

[11] Patent Number: 4,777,696

[45] Date of Patent: Oct. 18, 1988

[54] VACUUM CLEANER NOZZLE

[75] Inventors: Clarence E. Hawley, Roselle; Michael A. Alvarez, Haskell; H. Gerald Young, South Plainfield, all of N.J.

[73] Assignee: The Regina Co., Inc., Rahway, N.J.

[21] Appl. No.: 886,504

[22] Filed: Jul. 17, 1986

[51] Int. Cl.[4] ..... A47L 9/06

[52] U.S. Cl. ..... 15/373; 15/368

[58] Field of Search ..... 15/368, 371, 373

[56] References Cited

U.S. PATENT DOCUMENTS

| | | | |
|---|---|---|---|
| 2,034,196 | 3/1936 | Martinet . | |
| 2,591,262 | 4/1952 | Humphrey . | |
| 2,961,689 | 11/1960 | Meyenhoefer | 15/373 |
| 3,040,364 | 6/1962 | Carlberg | 15/373 |
| 3,667,084 | 6/1972 | Valbona . | |
| 3,832,753 | 9/1974 | Crooks | 15/371 |
| 3,913,168 | 10/1975 | Lovgren | 15/371 |
| 3,952,363 | 4/1976 | Lindman | 15/373 |
| 4,592,111 | 6/1986 | Berfield | 15/371 |
| 4,638,526 | 1/1987 | Murata et al. | 15/373 |

FOREIGN PATENT DOCUMENTS 56904 7/1967 German Democratic Rep. .

*Primary Examiner*—Harvey C. Hornsby
*Assistant Examiner*—C. Reinckens
*Attorney, Agent, or Firm*—Martin LuKacher

[57] ABSTRACT

A vacuum cleaner nozzle with a retractable brush having a plate carrying strips of bristles along the forward and rearward edge thereof and having leaf springs extending from one side and cam following members extending from the opposite side. A slide having camming members in engagement with the cam following members of the brush plate. The slide and brush plate are captured in a housing into which a conduit from the vacuum source extends through the housing and out of a sole plate, which is removably secured to the top plate and against which the brush plate leaf springs bear. Projections from the slide extend through the top of the housing and move the slide laterally in one direction to bring the brush through openings along the forward and rearward edges of the sole plate against the bias of the leaf springs to extend the brush. The projections move laterally in the opposite direction to permit the springs to retract the brush. Indentations at the opposite ends of a ramp provided by the cam follower member on the brush plate latch with the camming member on the slide so as to retain the brush plate with the brushes either in extended or retracted position.

17 Claims, 4 Drawing Sheets

VACUUM CLEANER NOZZLE

DESCRIPTION

The present invention relates to vacuum cleaner nozzles, and particularly to vacuum cleaner nozzles with retractable brushes.

The invention is especially suitable for use in vacuum cleaners which are desirably manufactured at low cost so as to reach a wide market, and without sacrificing any significant features of operation, such as the ability to reach and extract dirt from corners and irregular surfaces, whether soft surfaces or hard surfaces, as may be presented by rugs and hardwood floors.

Vacuum cleaner nozzles with retractable brushes have been proposed heretofore. Typical designs are shown in U.S. Pat. Nos. 3,952,363; 3,667,084; 2,591,262 and 2,034,196 and East German Patent No. 56904. The problem presented by these designs is their complexity. The nozzles are labor-intensive in their manufacture and assembly thereby excluding a large portion of the market which is attracted by low cost vacuum cleaner equipment.

It is the principal object of the present invention to provide an improved vacuum cleaner nozzle having retractable brushes wherein the required parts are reduced in number in that individual parts provide multiple functions.

It is a further object of the present invention to provide an improved low cost vacuum cleaner nozzle which contains fully the features of higher priced nozzles including retractable brushes, corner cleaning capability and the ability to remove dirt from hard or soft floors.

It is a still further object of the present invention to provide an improved low cost vacuum cleaner nozzle having retractable brushes which may easily be manipulated by readily accessible controls to extend or retract the brushes.

Briefly described, an improved vacuum cleaner nozzle provided by the invention has a housing with a top or cover member and a sole or bottom member the sole member presents a surface to the floor and an opposite surface to a chamber interiorly of the housing. A conduit, which is connected to a pipe which is connected to and may form part of the top member of the housing is canted with respect to the housing and is connected to the vacuum conduit of a vacuum cleaner, such as the Electrikbroom ® stick-vac vacuum cleaner sold by the Regina Company of Rahway, New Jersey U.S.A. The sole member has an extension connected to the conduit which communicates the vacuum to indentations in the sole plate which can extend to the corners of the plate for corner cleaning. The sole plate also has openings, preferably along its forward and leading edges. A brush plate containing brushes which are adapted to extend through the openings in the sole plate is assembled with a slide plate in the chamber interiorly of the housing. The slide plate has actuating projections which extend upwardly through openings in the top member of the housing and is slideable laterally in opposite directions in order to extend or retract the brushes. The brush plate has a multitude of functions. In addition to carrying the brushes, it has leaf springs which extend from one side thereof and bear against the interior surface of the sole. The brush plate has at least one cam follower member on the opposite surface thereof which is engaged with a cam extending downwardly from the slide. The cam follower may have a ramp with indentations at opposite ends thereof which engage and hold tipped portions of the cam on the slide so as to latch the brushes in either their retracted or extended positions. All of the parts except for screws which hold the top and sole members of the housing together are preferably molded from plastic, such as polypropelyene. The brush plate with its cantilevered leaf springs and cam follower is molded as an integral member. The brushes are preferably molded integrally as part of the brush plate, but may be strips of bristles which are glued or welded along the forward and rearward edges of the brush plates. Posts integrally molded with the top member of the housing and the conduit which communicates the vacuum to the cleaner air pump guide the slide for lateral movement. Posts which also may be integrally molded with the sole member guide the brush plate for reciprocal movement in a direction perpendicular to the movement of the slide when the brushes are extended and retracted.

The foregoing and other objects, features and advantages of the invention as well as a presently preferred embodiment thereof will become more apparent from a reading of the following description in connection with the accompanying drawings in which.

Figure 1:
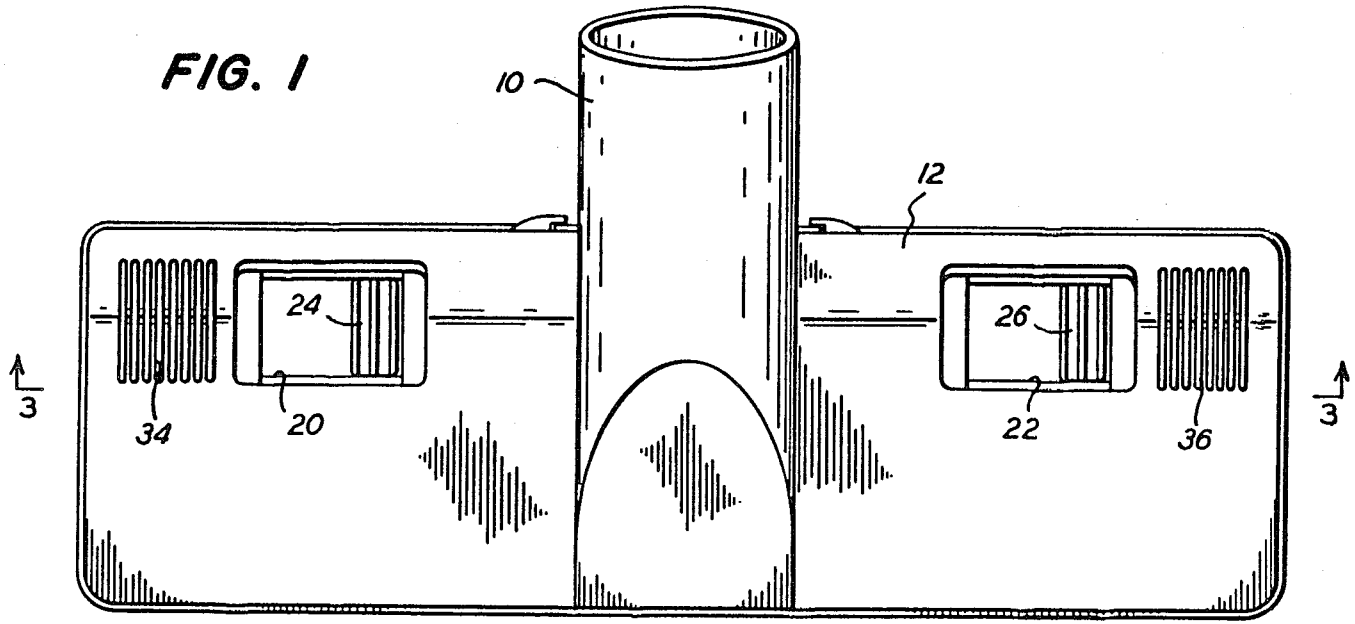
FIG. 1 is a top plan view of a vacuum cleaner nozzle in accordance with the invention.
Figure 2:
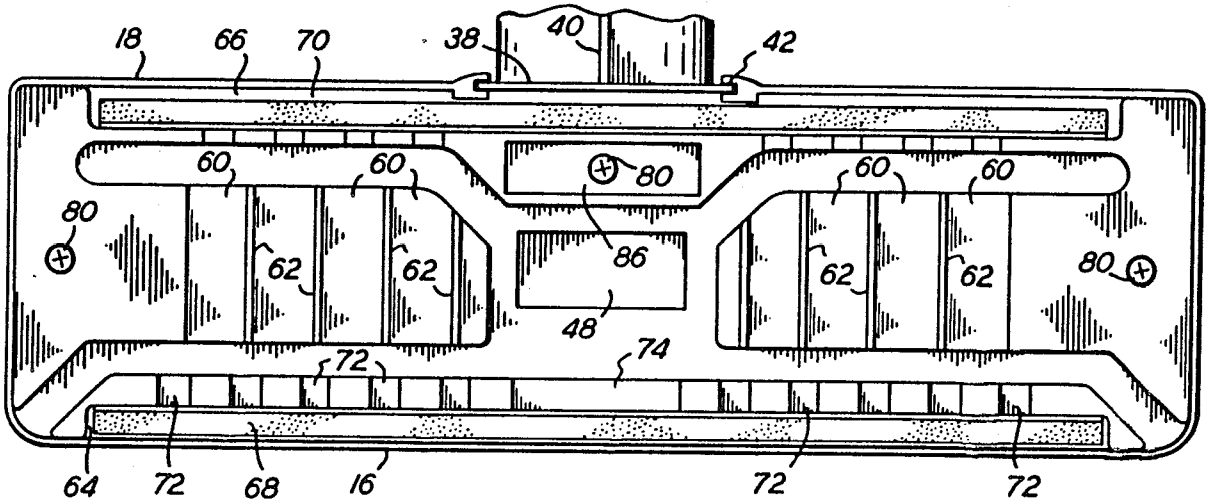
FIG. 2 is a bottom plan view of the vacuum cleaned nozzle shown in FIG. 1.
Figure 3:
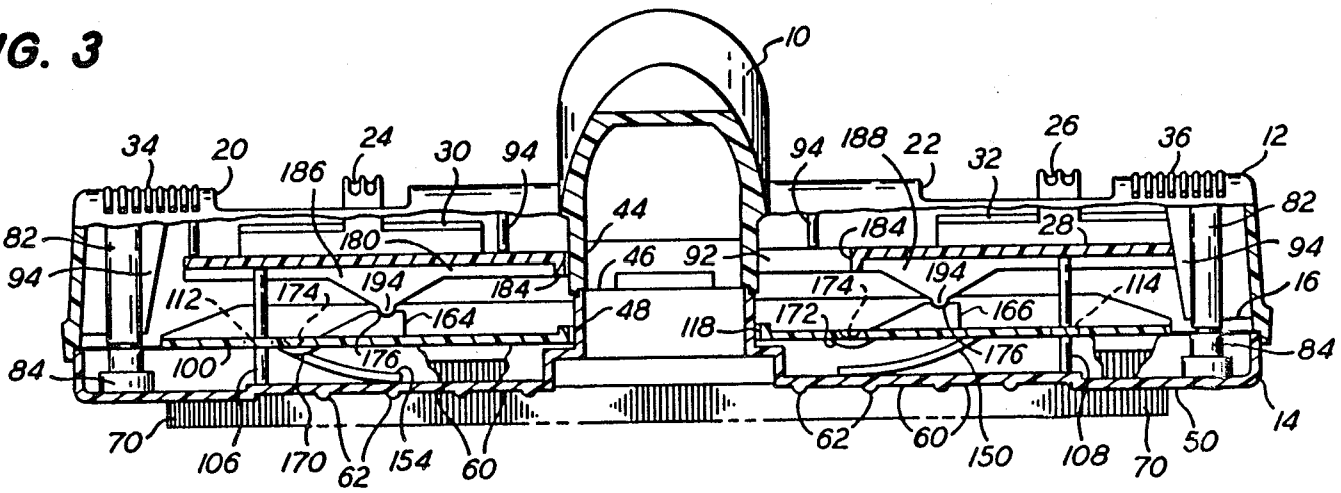
FIG. 3 is a sectional view taken along the line 3—3 in FIG. 1 and showing the nozzle with the brushes extended.

Referring to the drawings, the vacuum cleaner nozzle has a pipe 10 which extends downwardly with its axis at approximately 45° to the horizontal to the top or cover member 12, which with the bottom or sole 14 defines the housing of the nozzle. As shown in FIGS. 2 and 3, the top member 12 and the sole 14 are both dish-shaped and have side walls which overlap at their intersection 16. The sole 14 is rounded in cross section from its forward edge 16 to its rearward edge 18. The radius of the rounded bottom may be approximately four times the width of the sole plate between the forward and leading edges 16 and 18. This radius is a feature of the inventive nozzle in that it may be easily rocked on the floor so as to bring the suction passages into alignment with dirt carrying regions, for example at the corners of the sole 14, to reduce the size of the friction surface presented by the sole to the floor and to conform with soft floor surfaces.

Figure 7:
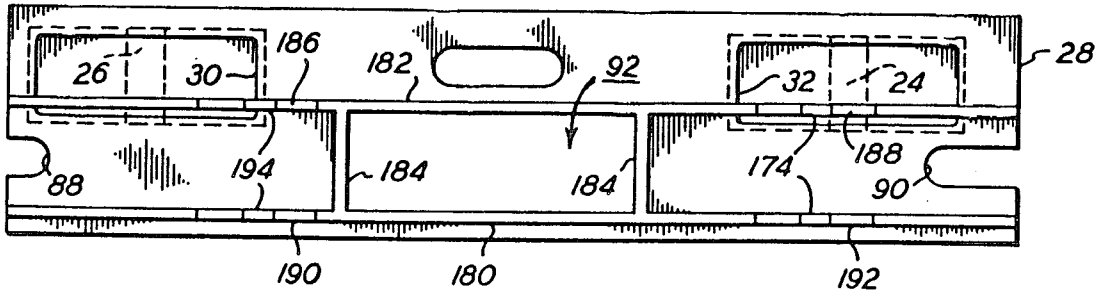
FIG. 7 is a bottom plan view of the slide which is used in the vacuum cleaner shown in FIGS. 1 through 4.

The top member 12 is of greater height towards the rear edge thereof than towards the front so as to provide a region having openings 20 and 22 through which project serrated control members 24 and 26. These members project from the slide 28 and are centrally located on rectangular bosses 30 and 32 on the upper surface of the slide 28 (see also FIG. 7). The higher, rearward portion of the top member 12 of the housing provides room for the bosses 30 and 32 and the control members 24 and 26 of the slide. The serrations or ribs 34 and 36 on the top member 12 of the housing adjacent to the openings 20 and 22 match the serrations at the top of the control members 24 and 26 for decorative purposes.

The pipe 10 may be molded integrally with the top member 12. To facilitate molding, the lower hemisphere of the pipe 10 may be provided with a downwardly extending plate 38 and strengthened with a gusset 40. The plate fits into a dove-tail receptacle 42. When the pipe is fitted into the pipe leading from the vacuum cleaner, a sufficiently air-tight connection is made. The pipe 10 leads to a generally rectangular section 44 within the top member 12, which extends downwardly and overlaps at an intersection 46 (see FIG. 3) with a generally rectangular conduit 48 which extends upwardly from the bottom surface 50 of the sole 14. As shown in FIG. 2, extending outwardly from the conduit 48 to approximately the same depth (approximately 200 mils) are lateral passages (indentations) 52 and 54 which communicate the vacuum to the floor engaging surface of the sole 14. The passage 54, which is towards the front of the sole 14, extends angularly to the forward corners 56 and 58 of the sole plate so as to communicate vacuum for corner cleaning purposes. A series of indentations 60 separated by ribs 62 communicate with the indentations 54 and 52 so as to extend vacuum pressure across most of the curved bottom surface 50 of the sole 14.

The sole has notches which form openings 64 and 66 along its forward and rearward edges. These are the openings through which the brushes 68 and 70 can move generally vertically so as to be extended from and retracted into the housing. When the brushes are extended, as shown in FIG. 3, they are exposed to agitate the floor, for example the rug which is to be cleaned. When the brushes are retracted, as shown in FIG. 4, they do not extend below the surface 50 of the sole plate so as to present a smooth surface especially suitable for cleaning hard floors such as hardwood floors, linoleum, tile and the like.

The surface 50 of the sole 14 has laterally spaced, smaller indentations 72 and a larger, centrally disposed indentation 74 which communicates vacuum from the passage 54 to the brush opening 64. Similarly series of indentations 76 which are laterally spaced in the ridge 78 between the rearward passage 52 and the rear brush opening 66, communicate vacuum to the rear brush opening 66. A separate indentation 81 may be provided for receiving a strip of material adapted to attract lint.

Figure 4:
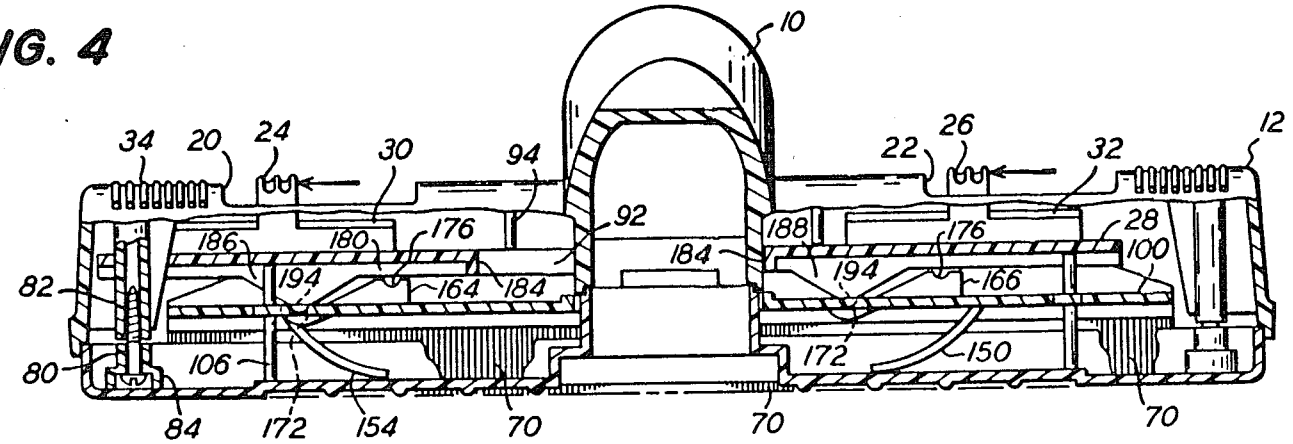
FIG. 4 is a sectional view similar to FIG. 3, but with the brushes retracted.

The sole 14 and the top 12 of the housing are assembled with three screws 80, one of which is shown in section on FIG. 4. These screws extend through aligned posts 82 and 84 in the top member 12 and sole 14 of the housing. The posts also extend through openings 88, 90 and 91 in the slide 28 (see FIG. 7) and guide the slide for lateral movement. The slide also has an opening 92 through which the rectangular conduit section 44 extends and provides additional guidance for lateral movement of the slide (see also FIGS. 3 and 4). Gussets 94 may also be molded with the posts and interiorally near the top of the top members 12 to provide additional strength, if required.

Figure 5:
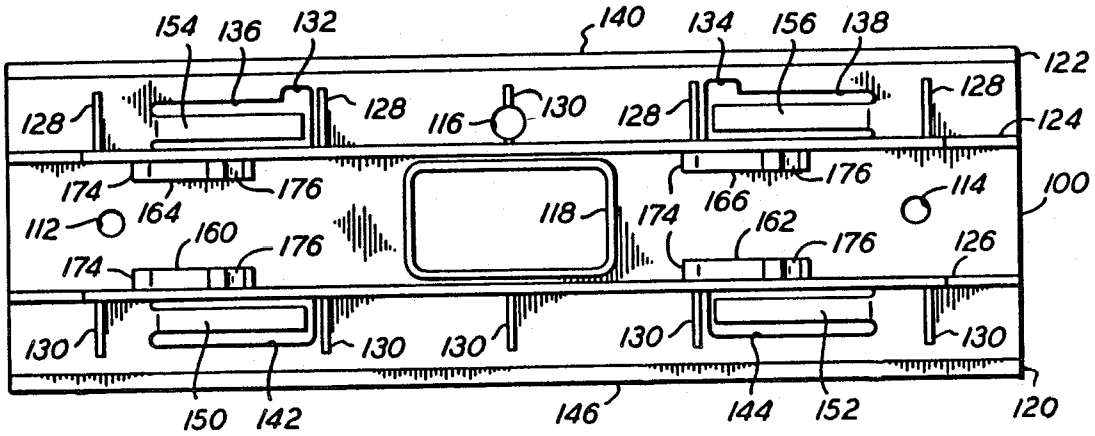
FIG. 5 is a top plan view of the brush plate of the vacuum cleaner nozzle shown in FIGS. 1 through 4.
Figure 6:
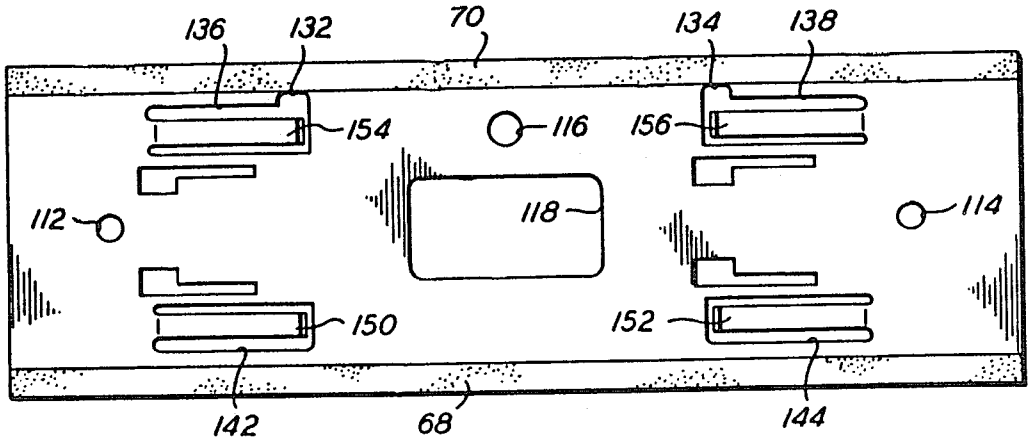
FIG. 6 is a bottom plan view of the brush plate shown in FIG. 5.

Aside from the top and sole members 12 and 14 of the housing, the only two additional parts of the nozzle are the slide 28 and a brush plate 100. The brush plate is shown in FIGS. 3 and 4 and also in FIGS. 5 and 6. Preferably it is an integral molded piece, including the brushes 68 and 70 which may be bristles of polypropelyene arranged in a plurality of rows (four rows being suitable) along the rearward and forward edges of the brush plate 100. The brushes are desirably made of bristle groups different height, as shown in FIG. 3, in laterally adjacent sections so as to provide for light or heavy agitation depending upon how hard the nozzle is pressed down into the floor surface being cleaned.

The brush plate 100 is guided for generally vertical movement by laterally-spaced pins 106 and 108 which are molded in the sole 14 and extend upwardly from the interior surface 110 of the sole 14. These posts 106 and 108 extend through holes 112 and 114 in the brush plate 100. Another hole 116 in the brush plate provides a passage for the post (not shown) which receives one of the screws 80 closest to the rear edge 18. The brush plate 100 also has an opening 118 for the conduit 48 which extends upwardly from the sole 14. The brush plate is formed of relatively thin plastic material and has downwardly extending skirts 120 and 122 from which flanges extend. The brushes 70 and 68 extend from the flanges. The brush plates are also strengthened by laterally extending ribs 124 and 126 which are further strengthened by gussets 128 and 130.

Further guidance for the reciprocal movement of the brush plate may be provided by rectangular posts (not shown) which extend upwardly from the sole 14 through notches 132 and 134 in the rearward edges of openings 136 and 138. These openings 136 and 138 are disposed between the ribs 124 and the rearward edge 140 of the brush plate 100. Another set of openings 142 and 144 are located between the forward rib 16 and the forward edge 146 of the brush plate 100. In the course of molding, the brush plate 100, the material from these openings 136, 138, 142 and 144 is formed into leaf springs 150, 152, 154 and 156. These leaf springs are cantilevered from the brush plate and engage the interior surface 110 of the sole 14. The springs bias the brush plate upwardly so as to permit the brushes 68 and 70 to be retracted.

The upper side of the brush plate is formed with cam follower members 160, 162, 164 and 166. These members are disposed in pairs symmetrically with respect to the center of the brush plate, just as the cantilevered leaf springs 150 to 156 are disposed symmetrically with respect to the center of the plate 100. The symmetrically disposed arrangement of springs and cam followers distributes and balances the forces on the brush plate so as to preclude lock ups and provide redundancy in the event of fractures. The cam follower members 160 to 166 have ramp portions (see FIGS. 3 and 4), the lower ends of which extend below the top surface of the plate 100. The plate 100 may be thickened as shown at 170 and 172 so as to permit the extension of the lower end of the ramps. At this extension and in a surface parallel to the top surface of the plate 100 there are provided indentations 174 and 176. These indentations act as latching detents for latching the brush plate with the brushes 68 and 70 in their extended or retracted positions.

The extension and retraction of the brush plate is caused by the lateral movement of the slide 28. The slide has ribs 180 and 182 which extend laterally. The ribs and the slide plate may be strengthened by laterally extending ribs 184 which extend downward and form the lateral endwalls of the hole 92. The ribs 180 and 182 are also formed into camming members 186 through 192. These camming members are disposed in pairs in alignment with the pairs of cam follower members 160, 164 and to 166 which extend upwardly from the brush plate 100. These camming members are triangular (obtuse, equilateral triangles) with nibs at their tips 194 (see FIGS. 3 and 7). These tips enter the indentations 174 or 176. When the tips 194 of the camming members 186 through 192 are in the indentations 176 as shown in FIG. 3, the brushes 68 and 70 are extended. When the slide 28 is moved to the left as shown in FIG. 4, the camming members 186 to 192 move towards the left down the ramps of the cam follower members 160 to 166. The tips 194 enter the lower indentations 172 and the brushes 68 and 70 are latched in the retracted position.

From the foregoing description, it will be apparent that there has been provided an improved nozzle with retractable brushes having a minimum number of parts which requires a minimum of assembly labor thereby enabling the vacuum cleaner incorporating such a nozzle to reach a large market for low-cost vacuum cleaners. Variations and modifications of the herein described suction nozzle, within the scope of the invention, will undoubtedly suggest themselves to those skilled in the art. Therefore, the foregoing description should be taken as illustrative and not in a limiting sense.

We claim:

1. A vacuum cleaner nozzle which comprises a housing having a sole member and a top member defining a hollow chamber, said sole member presenting a surface on one side thereof to the floor to be cleaned and on the opposite side thereof to said chamber, a conduit for air flow attached to said top member and extending to said sole surface for communicating vacuum thereto, said sole member having at least one opening therethrough into said chamber, a plate disposed within said chamber, a brush on said plate disposed in alignment with said opening, means mounting said brush plate in said chamber for extendable and retractable movement of said brush through said opening in said sole member outwardly and inwardly from said floor side surface of said sole member, a slide disposed in said chamber and moveable in opposite directions transversely with respect to said brush plate, said slide having upper and lower sides, an adjusting member projecting from the upper side of said slide through said top member, a camming member projecting from the lower side of said slide, said brush plate having upper and lower sides respectively facing said lower side of said slide and said opposite side of said sole member, said brush plate having at least one leaf spring cantilevered from said lower side thereof and extending into engagement with said opposite side of said sole member, said brush plate having a cam follower member projecting upwardly from said upper side of said brush plate into engagement with said camming member on said slide for enabling said brush plate to be cammed downwardly against the bias of said cantilever spring to extend said brush when said slide is moved in one of said opposite directions and to permit said brush to retract when said slide is moved in the other of said opposite directions.

2. The vacuum cleaner nozzle according to claim 1 wherein indentations are provided in said cam follower member on said brush plate, said indentations being spaced from each other in the direction of movement of said slide, a projection at the lower tip of the camming member on said slide latchable in said indentations when moved to spaced positions whereby to retain said brush in its extended and retracted positions.

3. The vacuum cleaner nozzle according to claim 2 wherein said cam follower member on said brush plate has a ramp, said indentations being disposed at opposite ends of said ramp.

4. The vacuum cleaner nozzle according to claim 3 wherein said indentation at one end of said ramp is disposed below the upper surface of said brush plate, said cam follower member having a surface at the opposite end of said ramp parallel to said brush plate upper surface, said latching indentations being disposed in said parallel surface and below the surface of said brush plate.

5. The vacuum cleaner nozzle according to claim 1 wherein said cantilever leaf spring is molded integrally with said brush plate.

6. The vacuum cleaner nozzle according to claim 5 wherein said camming member on said brush plate is also integrally molded with said brush plate.

7. The vacuum cleaner nozzle according to claim 6 wherein said brush plate is of plastic material and said cam member and said cantilever spring are integrally molded portions thereof.

8. The vacuum cleaner nozzle according to claim 1 wherein said sole member has a pair of openings parallel to each other along the forward and rearward edges thereof, said brush plate having a pair of strips each with bristles extending therefrom, said strips being disposed along forward and rearward edges of said brush plate in alignment with said openings in said sole member.

9. The vacuum cleaner nozzle according to claim 8 wherein said brushes are of longer and shorter length in sections of said strips spaced from each other along said strips.

10. The vacuum cleaner nozzle according to claim 1 wherein said opening in said sole extends laterally across said sole, said brush being a strip having bristles extendable therefrom through said opening, said bristles being of longer and shorter length in sections spaced laterally along said strip.

11. The vacuum cleaner nozzle according to claim 1 wherein said opening in said sole through which said brush extends is disposed along a laterally extending edge of said sole, said sole having passages between said vacuum conduit and said opening for communicating the vacuum to said opening to draw dirt agitated by said brush therethrough.

12. The vacuum cleaner nozzle according to claim 11 wherein said surface of said sole member which is presented to the floor has indentations therein providing passages between said conduit and at least two laterally spaced corners of said sole for communicating vacuum thereto.

13. The vacuum cleaner nozzle according to claim 12 wherein said passages between said openings for said brush and said passages which communicate vacuum to said opening for said brush extend between said opening for said brush and said indentations in said sole which provide said passages to said corners of said sole.

14. The vacuum cleaner nozzle according to claim 1 wherein said slide and said brush plate have at least a pair of said camming members and said cam follower members which are laterally spaced from each other and which are engagable with each other.

15. The vacuum cleaner nozzle according to claim 14 wherein at least a pair of said cantilever leaf springs is provided with each spring extending laterally and in an opposite direction from the other.

16. The vacuum cleaner nozzle according to claim 14 wherein said brush plate has two pairs of said cam follower members which are symmetrically disposed on said brush plate, said bush plate also having two pairs of said cantilever leaf springs also symmetrically disposed on said brush plate, said slide also having two pairs of camming members which are in engagement with said two pairs of cam follower members on said brush plate.

17. The nozzle according to claim 1 wherein said sole exterior surface is rounded from the forward to rearward edge thereof with a radium about four times the width between said forward and rearward edge.

* * * * *